US005489762A

United States Patent [19]

Martin et al.

[11] Patent Number: 5,489,762

[45] Date of Patent: Feb. 6, 1996

[54] APPLIANCES HAVING RESISTIVE HEATING ELEMENTS AND THERMAL PROTECTIVE APPARATUS USED THEREWITH

[75] Inventors: Lee C. Martin, Cranston, R.I.; Edward J. Ouillette, North Attleboro, Mass.; Henry A. Langlois, Lincoln, R.I.; Geoffrey S. Reno, Franklin, Mass.

[73] Assignee: Texas Instruments Incorporated, Dallas, Tex.

[21] Appl. No.: 248,776

[22] Filed: May 25, 1994

[51] Int. Cl.[6] ..... H01H 37/00; H05B 3/00

[52] U.S. Cl. ..... 219/510; 219/541; 337/298; 337/343

[58] Field of Search ..... 219/510, 541; 392/442; 337/298, 365, 349, 343, 372

[56] References Cited

U.S. PATENT DOCUMENTS

| | | | |
|---|---|---|---|
| 2,724,753 | 11/1955 | Miles | 337/349 |
| 3,430,177 | 2/1969 | Audette . | |
| 3,956,613 | 5/1976 | Dobson et al. | 219/436 |
| 4,319,214 | 3/1982 | Givler | 337/343 |
| 4,499,517 | 2/1985 | Lisauskas . | |
| 5,337,036 | 8/1994 | Kuczynski | 337/343 |
| 5,402,099 | 3/1995 | Ballard et al. | 337/298 |

*Primary Examiner*—John A. Jeffery
*Attorney, Agent, or Firm*—Russell E. Baumann; Richard L. Donaldson; René E. Grossman

[57] ABSTRACT

A thermal protector (70, 70') is shown particularly suitable as a safety back-up mechanism for appliances having electrically energizable resistance heaters. The thermal protector has first (72, 72') and second (74, 74') electrically conductive housing members joined together through an electrically insulating gasket (76). A thermostatic snap acting disc (86) is cantilever mounted on one of the housing members and adapted to move between positions in and out of electrical engagement with the other housing member in dependence upon temperature. The snap acting disc (86) has an actuation temperature selected from approximately 70° C. to 175° C. and, for non-resettable applications, a reset temperature of −35° C. A terminal platform (100, 100') is provided on one housing member extending lengthwise beyond the other housing member and essentially along the entire width of the protector so that a relatively rigid heater element terminal pin (32) can be placed transversely, generally parallel to the end of the protector and welded thereto to provide improved heat transfer as well as a rigid mount for the protector. The welding platform is shown provided with a stop tab member (102) to aid in positioning the terminal pin (32) at the time of welding.

22 Claims, 5 Drawing Sheets

APPLIANCES HAVING RESISTIVE HEATING ELEMENTS AND THERMAL PROTECTIVE APPARATUS USED THEREWITH

BACKGROUND OF THE INVENTION

This invention relates generally to appliances having resistive heating elements and thermal protective apparatus used with such appliances and more particularly to thermal protectors having thermostatic discs movable from a circuit engaging position to a circuit disengaging position upon reaching a preselected elevated temperature to thereby de-energize an appliance having an electrically energizable heating element.

Appliances such as coffee makers, steam cookers, steam irons and the like, typically have a sheathed heating element having a relatively rigid terminal pin at each end. Line current is connected through an on/off switch to a thermostat, thermally coupled to the heating element, and in turn to the heating element so that energization of the heating element is cycled on and off to maintain the temperature of the heating element within selected upper and lower limits.

Safety concerns require that a back-up mechanism be provided to de-energize the heating element in the event that the thermostat malfunctions in order to prevent run-away conditions with concomitant excessive temperatures and the possibility of starting a fire. Conventionally, in a coffee maker, for example, a fuse is serially connected to each side of the power source lines, i.e., both to the "hot" and neutral sides. Each fuse is inserted into an electrically insulative sleeve and held in close thermal contact with the sheathed heating element by means of a clip. While this can be effective as a safety back-up mechanism, it requires the addition of several components and assembly operations.

SUMMARY OF THE INVENTION

It is an object of the present invention to provide a thermal back-up system for appliances having resistive heaters which require fewer components and assembly operations than are presently employed in the prior art. Another object is the provision of a thermal protector particularly adapted for use with sheathed heating elements of appliances to de-energize the heating elements when the temperature of the heating elements rise to a preselected level. Yet another object of the invention is the provision of a thermal protector having an improved heat coupling to a sheathed heating element to optimize its response to over-temperature conditions. Another object is the provision of a thermal protector of the type that functions as a non-resettable, or one-shot, device. Still another object of the invention is the provision of an automatically resettable thermal protector having improved heat coupling to an electrically energizable device.

Other objects and features of the invention will become more readily understood from the following detailed description and appended claims, when read in conjunction with the accompanying drawings in which like reference numerals designate like parts throughout the figures thereof.

Briefly, in accordance with the invention, a thermal protector comprises first and second electrically conductive housing members connected to one another through an electrically insulative element to electrically separate the housing members from one another. An electrically conductive thermostatic snap acting disc member having first and second opposite ends has one end mounted to one of the first and second housing members with the second end movable between first and second positions in and out of engagement respectively, with the other of the first and second housing members. One of the housing members has a welding platform extending out of an end of the thermal protector beyond the other housing member along the length of the thermal protector a distance at least as long as the radius of the largest terminal pin to which it is to be welded and extending essentially the entire width of the protector. An appliance with which the thermal protector is used includes a sheathed heating element having a relatively rigid terminal pin at each end of the heating element. According to a feature of the invention, the longitudinal axis of the distal free end of one of the terminal pins is placed on the welding platform so that it extends transversely, parallel to the end of the thermal protector along essentially the entire width of the welding platform and is welded thereto to provide a rigid support for mounting the thermal protector and optimizing the thermal coupling between the heater element and the thermal protector.

According to another feature of the invention a tab is provided on the welding platform extending upwardly along one side thereof to serve as a stop for positioning the terminal pin at the time of welding.

According to still another feature of the invention, the snap acting disc member has a set or actuation temperature of approximately between 70° and 175° C. at which it will snap from a contacts engaged position to a contacts disengaged position and a reset temperature of less than −35° C. for it to snap back to its original configuration so that in operation it serves as a non-resettable or "one-shot" disc. According to a feature of the invention, the thermostatic disc is formed of a plurality of metal layers bonded together with a first outer layer of relatively high coefficient of thermal expansion and a second outer layer having a relatively low coefficient of thermal expansion, the layers having similar moduli of elasticity with the second outer layer being a precipitation hardenable stainless steel.

In an alternative embodiment the disc is chosen so that it has a higher reset temperature so that, if desired, the device can be used to control the cycling on and off of an electrical device between selected maximum and minimum temperature limits.

DETAILED DESCRIPTION OF THE PREFERRED EMBODIMENTS

Figure 1:
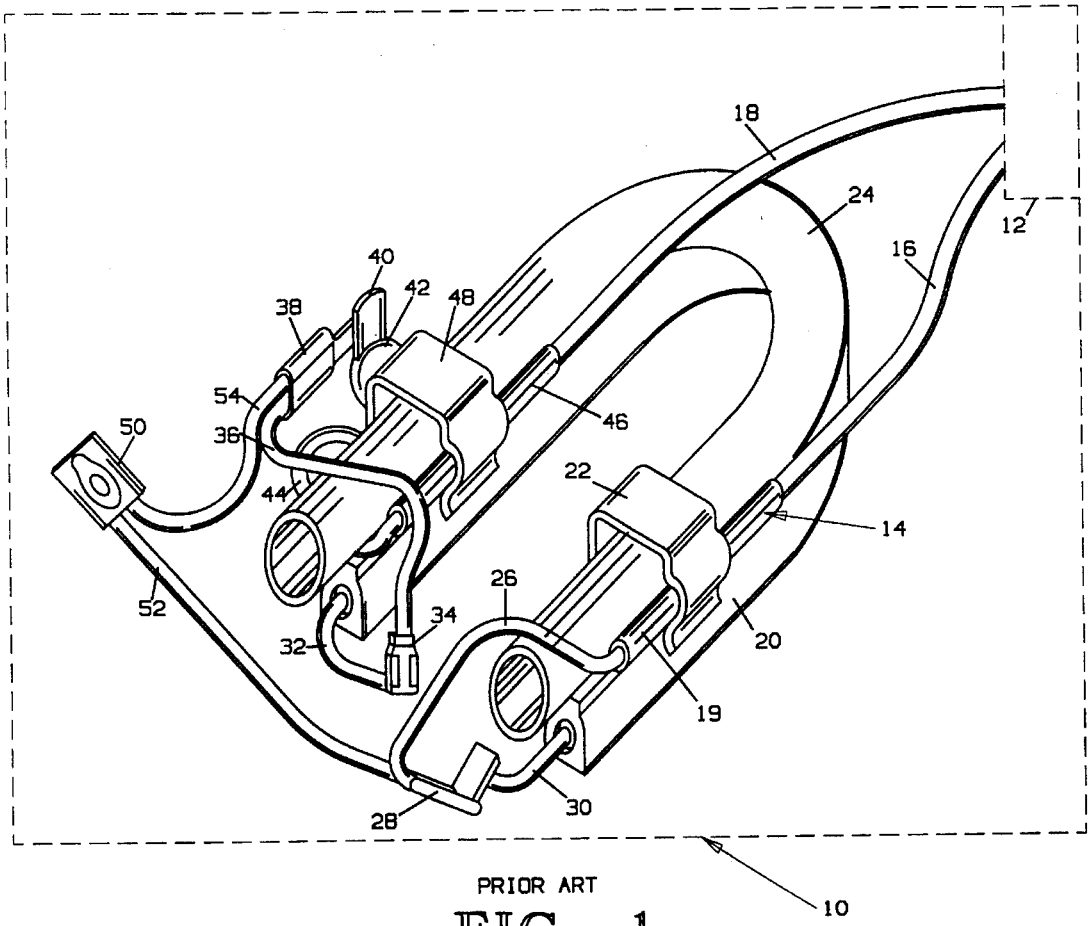
PRIOR ART FIG. 1
FIG. 1 is a schematic representation of an appliance including a perspective view of the heating assembly of the appliance having a conventional back-up safety mechanism.

With respect to FIG. 1, an appliance, such as a coffee maker, is represented by a dashed block 10 provided with a conventional back-up safety mechanism 14. A conventional on/off switch 12 is connected to lines 16, 18 with line 16 serially connected to a first fuse telescopically received within a sleeve 19 of electrically insulative material and biased into intimate heat transfer relation with a sheathed heating element 20 by means of a clip 22 received over the heating element and integrally coupled water tube 24. The other side of the first fuse is connected via line 26 to a connector 28 attached to terminal or cold pin 30 of heating element 20 in a conventional manner, as by welding. Terminal or cold pin 32 at the other end of heating element 20 has a connector 34 attached to it in the same manner as connector 28 and has a lead 36 leading to a connector 38 attached to terminal 40 of thermostat 42 in a conventional manner. The other thermostat terminal (not shown) is connected to line 44 which is connected to one side of a second fuse telescopically received in electrically insulative sleeve 46 with the other side of the second fuse connected to switch 12 via line 18. The second fuse and thermostat 42 are biased into intimate thermal engagement with heating element 20 and water tube 24 by means of a clip 48. A conventional lamp 50 is coupled to connectors 28, 38 by lines 52, 54, respectively to provide an indication of the state of energization of the heating element. Water tube 24 is coupled to the water supply/delivery portion of the appliance in a conventional manner, not shown.

When the appliance is energized through switch 12, essentially constant current flowing through the heating element 20 will cause the element to heat up with its temperature effectively limited by the thermal mass of the water in the system. When the water in the system is removed the temperature of the element will continue to rise until the temperature of the thermostat reaches a selected level. The thermostat then opens the electrical circuit and allows the heating element and water tube to cool to a selected reset level at which point it recloses the circuit. The appliance will then continue to cycle on and off within the selected temperature range until it is de-energized by switch 12. In the event that the thermostat fails, the temperature of the heating element/water tube will continue to increase until one of the fuses reaches its threshold actuation temperature at which temperature it will open the circuit to prevent excessive temperature conditions.

As stated above, it is desirable to provide a safety back-up system which has fewer components and is more easily and quickly assembled in the appliance, yet will still operate to de-energize the system within a given period of time, e.g., 85 seconds, in the event that the thermostat malfunctions and the temperature increases above the selected high limit.

A thermal protector having a thermostatic element movable to a contacts open configuration upon reaching a selected elevated temperature and having a reset temperature sufficiently low to make it act as a "one-shot" device could be used to replace the fuse elements by mounting it in an electrically insulative sleeve and biasing it into close thermal contact with the heating element in the same manner as the fuses however, a sleeve as well as additional lead means would still be necessary.

Figure 2:
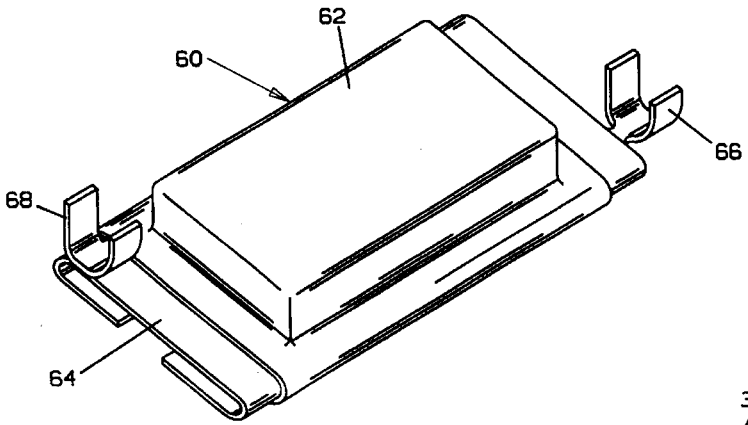
PRIOR ART FIG. 2
FIG. 2 is a perspective view of a thermal protector made in accordance with the prior art.
Figure 2A:
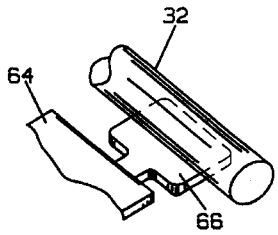
FIG. 2*a* is a broken away perspective of the FIG. 2 protector welded to terminal pin 32 via a flattened crimp connector.
Figure 3:
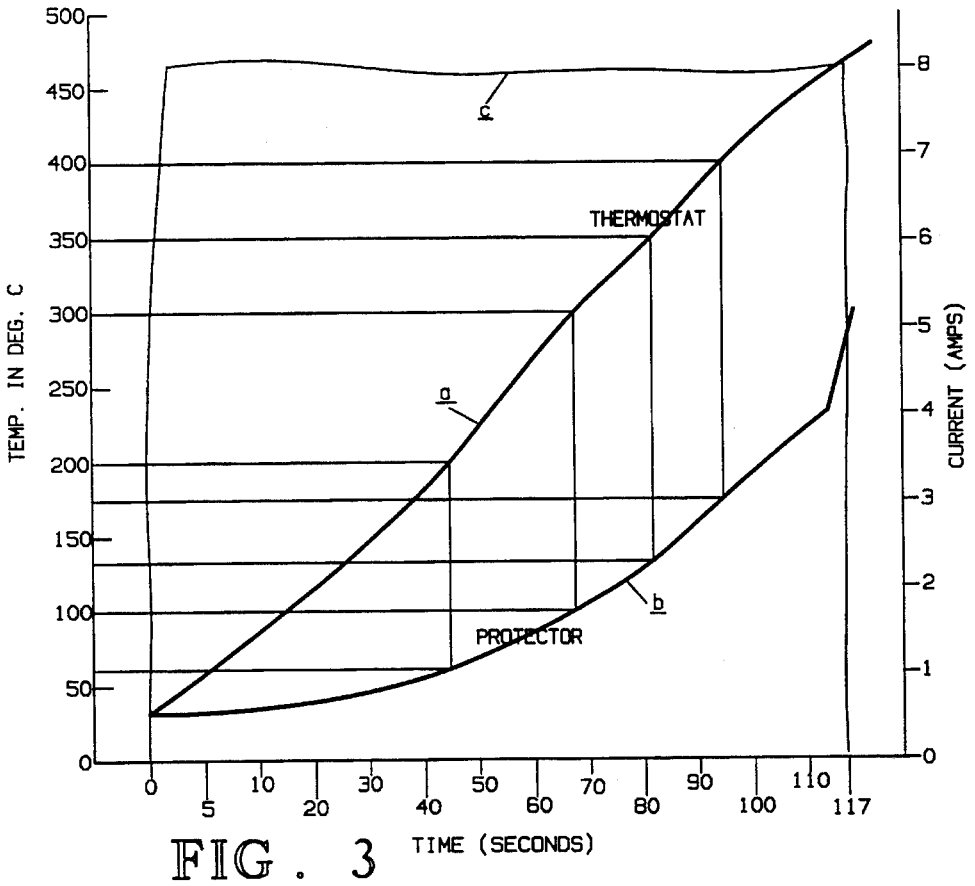
FIG. 3 is a graph of temperature vs time of the FIG. 2 protector and the thermostat used therewith. The graph also includes current through the heating element vs time. The protector was welded to a terminal of the heating element as shown in FIG. 2*a* and the thermostat was shorted out to simulate a malfunction.

A thermal protector of this type was tried without the use of an insulating sleeve by mounting it directly on one of the terminal pins of the heating element. With reference to FIG. 2, thermal protector 60, comprising a snap acting thermostatic disc (not shown) mounted within an electrically conductive can 62 and adapted to move between first and second positions in engagement with and out of engagement with a lid (not shown) mounted on the can but electrically separated therefrom by an electrically insulative gasket 64 was attached to terminal pin 32 by means of crimp connector 66, integrally attached to the lid of protector 60, welded to pin 32 as shown in FIG. 2*a* with connector 68 crimped to lead 36 leading to thermostat 42 replacing the first and second fuses, sleeves 19, 46 and clip 22. Protector 60 is a very effective protector device of the type set forth in U.S. Pat. No. 3,430,177 assigned to the assignee of the present invention, with literally billions having been made and used as a resettable device to protect a wide variety of electrical devices from over-temperature and over-current conditions. However, when welded to terminal pin 32 the thermal coupling was found to be insufficient to make the protector operate effectively as a back-up safety device. The results using a protector 60 having a snap acting disc with an actuation or set temperature of 150° C. are shown in FIG. 3. Line a indicates the temperature of thermostat 42 and line b indicates the temperature adjacent to protector 60 with the thermostat shorted out to simulate a malfunction. An essentially constant current c of approximately 8 amps resulted in increasing the temperature of thermostat 42 to above 450° C. with the temperature adjacent to the protector and, concomitantly the thermostatic disc, not increasing to a high enough level to de-energize the heating within a selected period of time, e.g., 85 seconds. At 117 seconds, energization was interrupted by means of a switch.

Figure 4:
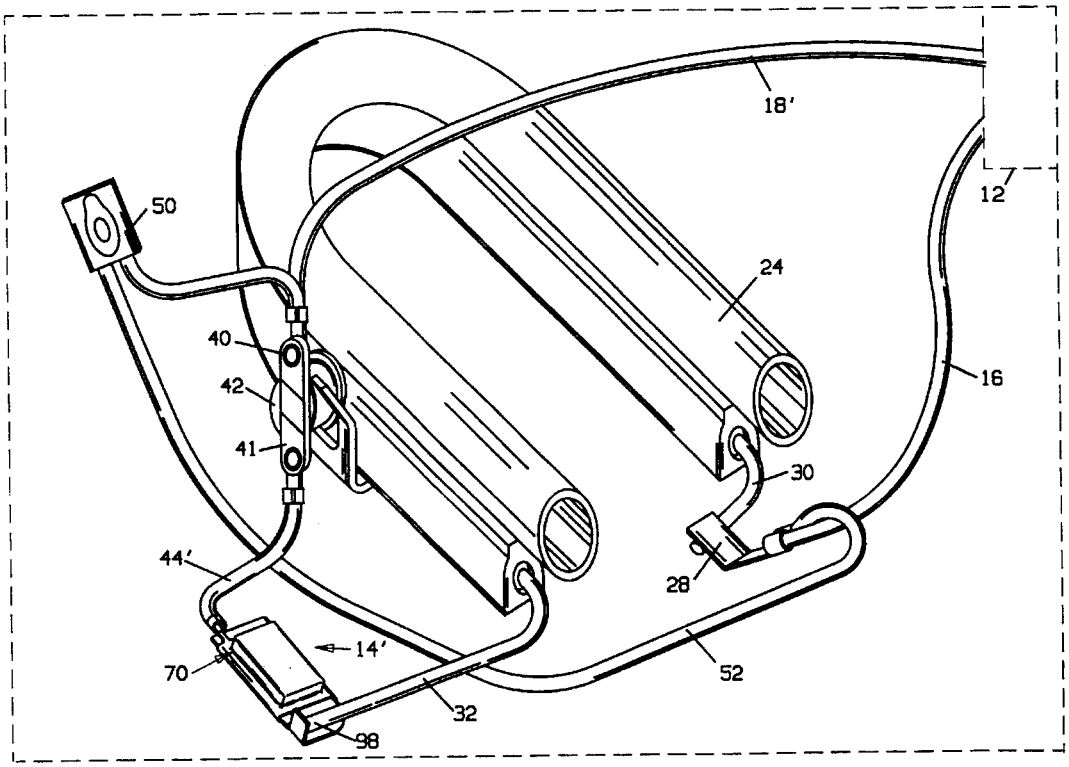
FIG. 4 is a view, similar to FIG. 1, of an appliance in which a thermal protector made in accordance with invention is mounted to a terminal pin of a heating element.

FIG. 4 shows an appliance 10' similar to that of FIG. 1 but with a thermal safety back-up mechanism 14' made in accordance with the invention. Line 16' leads from an on/off switch 12 directly to connector 28 attached to terminal pin 30 while protector 70 is mounted directly on terminal pin 32 in a manner to be described in greater detail below. Protector 70 has a crimp connector 98 connected to wire 44' which leads to terminal 41 of thermostat 42 while terminal 40 is connected to switch 12 by wire 18'.

Figure 6:
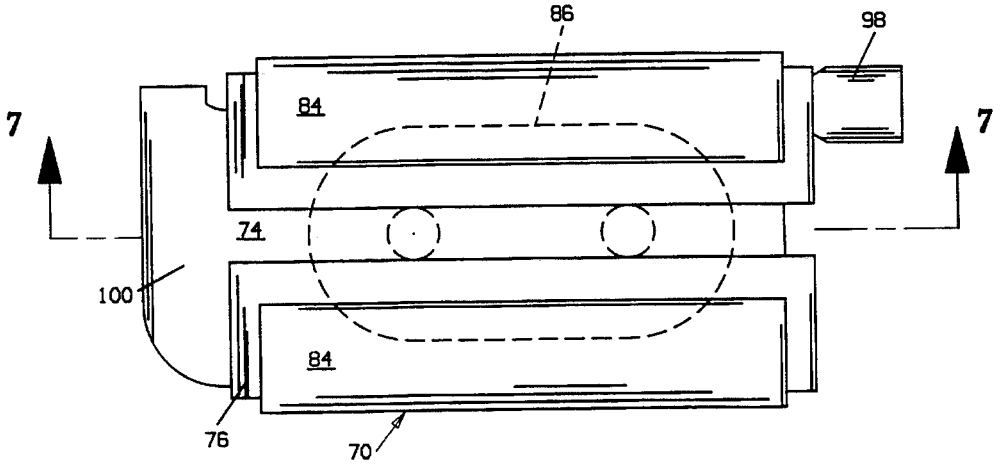
FIG. 6 is a top view of a thermal protector shown in FIG. 4, the bottom of the protector being shown facing upwardly in FIG. 4.
Figure 7:
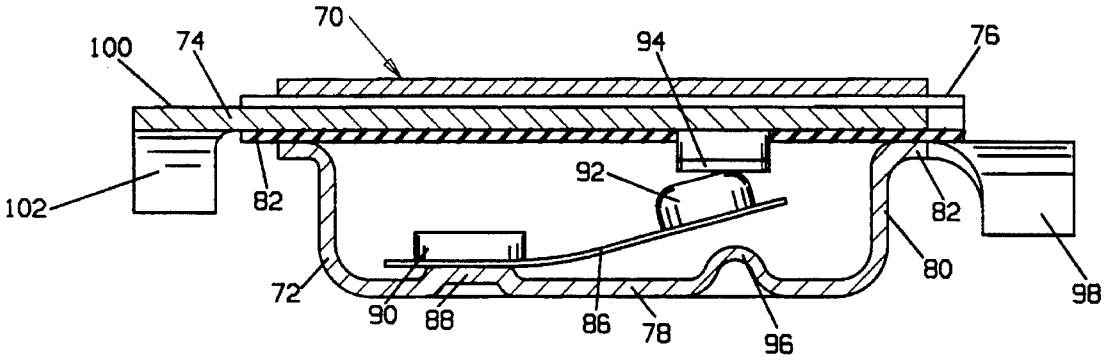
FIG. 7 is a cross sectional view taken on line 7—7 of FIG. 6.
Figure 8:
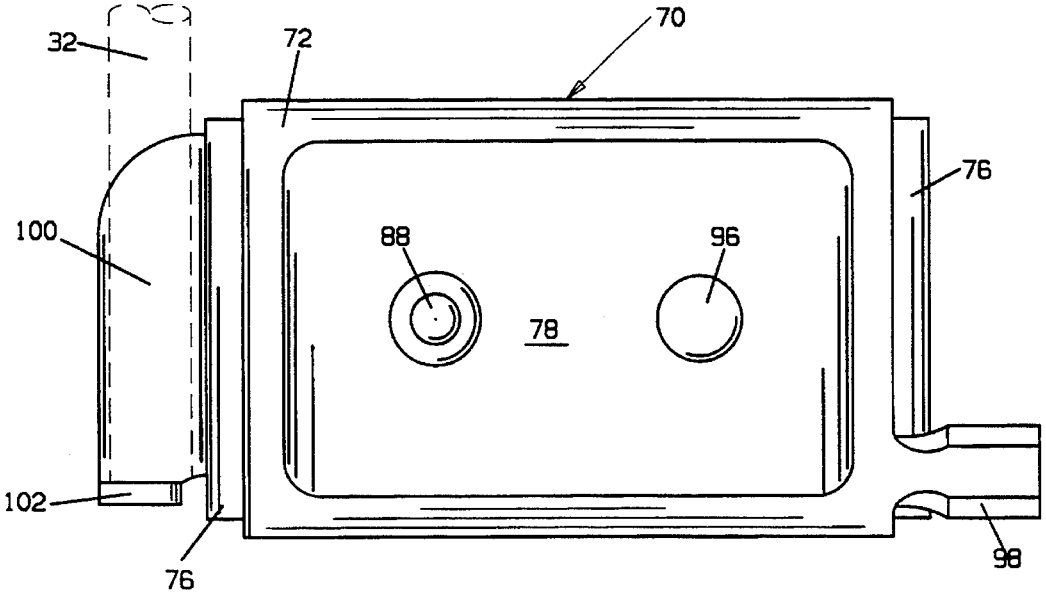
FIG. 8 is a bottom view of the FIGS. 6, 7 protector.

With particular reference to FIGS. 6–8, thermal protector 70 is formed of first and second housing members 72, 74 respectively of suitable electrically conductive material such as AISI type 1008 cold rolled steel. AISI is a designation of the American Iron and Steel Institute. Housing members 72, 74 are joined to each other through an electrically insulative gasket 76. Housing member 72 is configured generally as a can having a bottom wall 78, sidewall 80 extending upwardly from bottom wall 78 and formed with a seating flange 82 around the periphery of the sidewall 80 at its upper free end. Seating flange 82 is extended in width on two opposite sides at 84 and bent over to capture housing member 74, which serves as a lid closing a switching chamber, and gasket 76.

A thermostatic snap acting disc 86 has a first end mounted on an inwardly formed projection 88 in bottom wall 78 as by welding thereto by weld button 90. The second, opposite end of disc 86 is provided with an electrical contact welded thereto in alignment with a stationary electrical contact 94 welded on housing lid member 74 and projecting into the switching chamber through a window formed in gasket 76. If desired, bottom wall 78 may be formed with an inwardly projecting stop 96 to limit travel of disc 86 in the contacts disengaging motion. Thermostatic snap acting disc 86 is movable between first and second positions in and out of electrical engagement, respectively with housing lid member 74 in dependence upon the temperature of the disc, as will be discussed in further detail below.

A crimp connector is integrally attached to housing member 72 at one end of the thermal protector while housing lid member 74 extends beyond the housing member 72 along the length of the protector for a selected distance and extends essentially the full width of the housing lid member 74 to form a weld platform 100. Preferably a tab 102 is formed along one side of platform 100 extending downwardly and lying in a plane generally parallel to the length of the protector, that is, parallel to a line extending from one end where crimp connector 98 is located and the opposite end where welding platform 100 is located. Tab 102 serves as a separator during manufacture of the protector by keeping the generally flat lid members 74 separated from one another in the conveyance apparatus feeding parts to the assembly equipment as well as serving as a locating or stop member for positioning the terminal pin to be welded to the platform.

With reference to FIG. 4, terminal pin 32, a relatively rigid member, is placed on welding platform 100 so that the longitudinal axis of the distal end of pin 32 extends transversely, parallel to the end of the protector and with the pin extending essentially from one side of the protector to the opposite side. The terminal pin 32 is welded to the welding platform in the position shown generally in dashed lines in FIG. 8 to provide an optimized heat coupling to the protector as well as to provide a rigid support for the protector. The rigid support maintains the protector in an isolated position separated from other components and as a result the protector can be used without having to place it within an electrically insulative sleeve member.

Heating elements with which the protector is intended to be used have terminal or cold pins which range in gauge depending on various factors, such as the heater wattage, but typically fall between 14 and 18 gauge, i.e., between 0.2108 and 0.10668 cm diameters respectively. The length that platform 100 extends beyond housing member 72 and gasket 76 is preferably selected to be at least equal to the radius of the largest terminal pin, or 0.1054 cm to facilitate welding of the pin to the platform.

Figure 5:
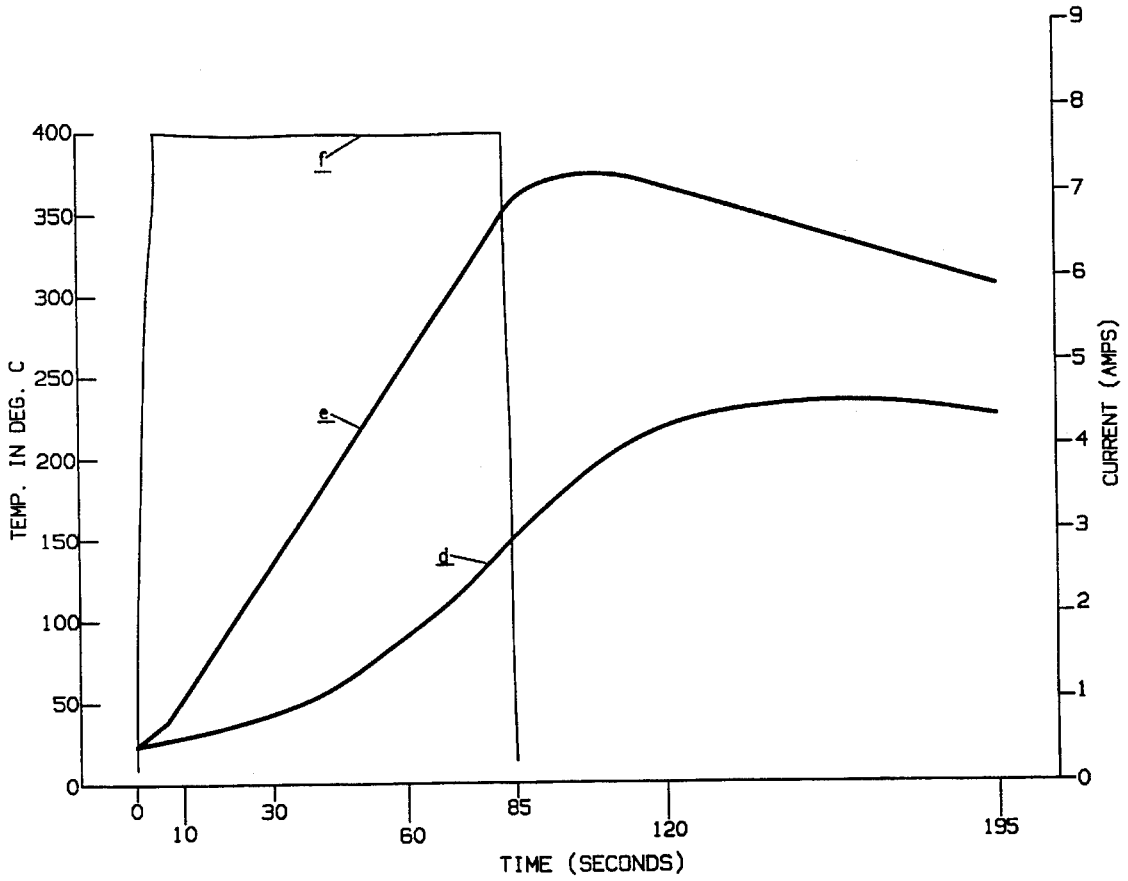
FIG. 5 is a graph similar to FIG. 3 of the FIG. 4 system.

A thermal protector as shown in FIGS. 4 and 6–8 and having a disc with an actuation set temperature of approximately 150° C. was built and tested in the same manner as described above in relation to FIG. 3 and with the results shown in FIG. 5. Curve e represents the temperature of the thermostat, curve d represents the temperature adjacent to protector 70 and curve f represents the current through the system. It will be seen that with an essentially constant current of approximately 8 amps the temperature adjacent to the protector reached the 200° C. level which in turn brought the temperature of the thermostatic disc to the 150° C. actuation temperature in approximately 85 seconds at which time the system was de-energized with the temperature of the thermostat not going appreciably over 350° C.

Thermostatic disc 86 may be chosen having an actuation or set temperature of anywhere from 70° C. to 175° C. and, where it is intended to use the protector as a non-resettable, or "one-shot" device, can have a reset temperature of no greater than −35° C. Devices of this type, for example, can be formed of a plurality of metal layers bonded together with a first outer layer of relatively high coefficient of thermal expansion and a second outer layer having a relatively low coefficient of thermal expansion, the layers having similar moduli of elasticity with the second outer layer being a precipitation hardenable stainless steel and the first layer being an alloy having from 0.12 to 0.61% by weight carbon. Thermostatic snap acting discs of this type are disclosed and claimed in copending application Ser. No. 08/166,757 filed Dec. 14, 1993, now U.S. Pat. No. 5,402,099, assigned to the assignee of the present invention, the subject matter of which is incorporated herein by this reference.

Figure 9:
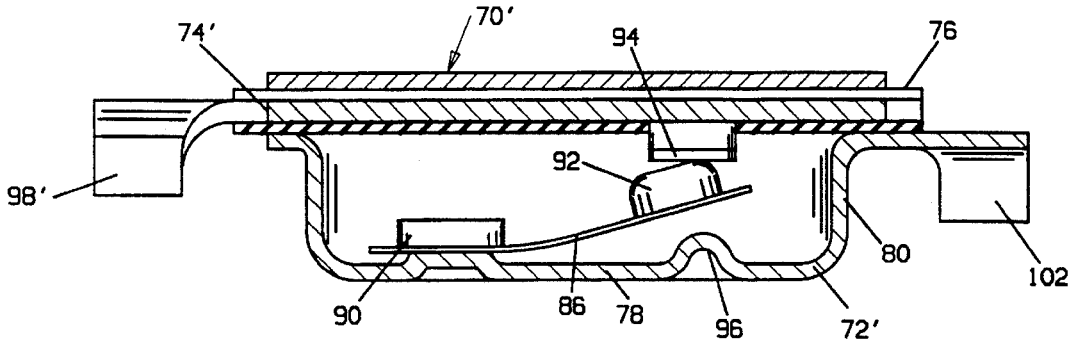
FIGS. 9 and 10 are cross section and bottom views, respectively of an alternate embodiment of the protector.
Figure 10:
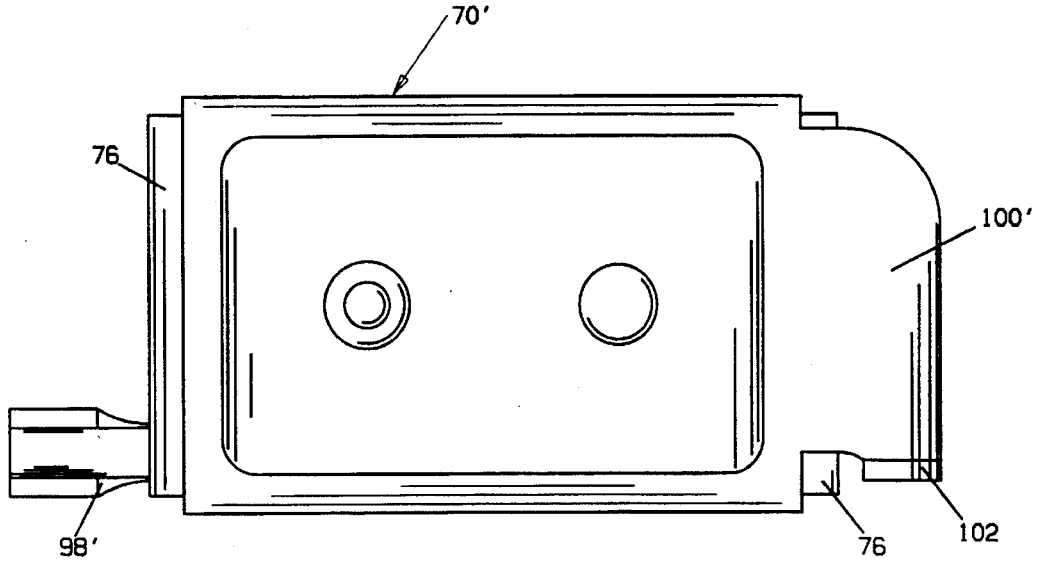

FIGS. 9 and 10 show an alternate embodiment in which protector 70' is provided with welding platform 100' in all respects the same as platform 100 except that it is integrally formed on housing member 72', the member having the sidewall 80 extending upwardly from bottom wall 78 while crimp connector 98' is integrally attached to housing lid member 74'. This structure provides an even more direct thermal path between the terminal pin welded to the welding platform and the thermostatic disc 86.

Although the disc 86 is shown cantilever mounted to the bottom wall of housing 72, 72', it is within the purview of the invention to mount the disc on the housing lid member 74, 74' if desired, and to mount the stationary contact on bottom wall 78, 78', as also shown in U.S. Pat. No. 3,430,177 referenced above.

In certain applications it may be desired to use a thermostatic snap acting disc which has a smaller differential temperature, i.e., one which has a reset temperature at a selected level, for example, 20° C., below the actuation temperature, so that the protector will automatically reset and cause the device to function as a thermostat for example.

Although the present invention has been shown and illustrated in terms of specific preferred embodiments, it will be apparent that changes and modifications are possible without departing from the spirit and scope of the invention as defined in the appended claims.

We claim:

1. An appliance having a housing and a heater element mounted therein, the heater element having first and second opposite ends and a rigid terminal pin having a free distal end with a longitudinal axis extending from an end of the heating element, a thermal protector, electrical leads for supplying power to the heating element through the thermal protector adapted to de-energize the heater element upon the occurrence of selected elevated temperature conditions, the thermal protector having a selected width and a selected length between first and second ends comprising first and second electrically conductive housing members connected to one another through an electrically insulative element to electrically separate the housing members from one another, an electrically conductive thermostatic disc member having first and second opposite ends, the first end of the disc member mounted to one of the first and second housing members, the second end of the disc member being movable between first and second positions in and out of engagement respectively, with the other of the first and second housing members, one of the housing members having a welding platform extending out an end of the thermal protector along the length of the thermal protector beyond the other housing member and electrically insulative element and extending essentially the entire width of the protector, the free distal end of the terminal pin of the heater element received on the platform extending essentially the entire width of the welding platform, the longitudinal axis of the free distal end of the terminal pin extending parallel to the end of the protector, the terminal pin being welded to the welding platform to provide a rigid support for mounting the thermal protector and optimizing the thermal coupling between the heater element and the thermal protector.

2. An appliance according to claim 1 in which the welding platform has a tab extending away from the platform along one side thereof to serve as a stop for positioning the terminal pin at the time of welding.

3. An appliance according to claim 1 in which the thermostatic disc member has an actuation temperature between approximately 70° C. and 175° C. at which temperature the disc will move from the first position in engagement to the second position out of engagement with the other of the first and second housing members.

4. An appliance according to claim 3 in which the thermostatic disc member has an actuation temperature of approximately 150° C.

5. An appliance according to claim 1 in which the thermostatic disc member has a reset temperature of no greater than −35° C. at which temperature the disc member will move from the second position out of engagement to the first position in engagement with the other of the first and second housing members.

6. An appliance according to claim 1 in which the thermostatic disc member comprises a plurality of metal layers bonded together with a first outer layer of relatively high coefficient of thermal expansion and a second outer layer having a relatively low coefficient of thermal expansion, the layers having similar moduli of elasticity and the second outer layer being a precipitation hardenable stainless steel.

7. An appliance protector according to claim 1 in which the welding platform extends out the end of the thermal protector beyond the electrically insulative element at least approximately 0.1054 cm.

8. A thermal protector having first and second ends along a length and having a selected width comprising an electrically conductive thermostatic snap acting disc member having first and second opposite ends, a generally cup-shaped electrically conductive housing member having a bottom wall and a sidewall extending upwardly from the bottom wall to a distal free end portion, flanges extending laterally outwardly from the distal free end portion, the flanges forming a seating area, an electrically insulative element disposed on the seating area, the insulative element formed with an opening therethrough, an electrically conductive housing lid member disposed over the cup-shaped housing member electrically separated from the cup-shaped housing member and having a width selected so that the housing lid member is generally co-extensive in width with the spaced flanges, one end of the disc member mounted to one of the cup-shaped housing member and the housing lid member, the second end of the disc member being movable between first and second positions in and out of electrical engagement with the other of the cup-shaped housing member and housing lid member respectively, one of the cup-shaped housing member and housing lid member extending beyond the other of the cup-shaped housing member and housing lid member and the electrically insulative element along the length of the protector to form a welding platform, the welding platform having a width essentially coextensive with the width of the protector.

9. A thermal protector according to claim 8 in which the welding platform is integrally formed on the housing lid member.

10. A thermal protector according to claim 8 in which the welding platform is integrally formed on the cup-shaped housing member.

11. A thermal protector according to claim 8 in which the welding platform has a tab extending from the platform along a side thereof to serve as a stop for positioning a terminal pin to be welded to the welding platform.

12. A thermal protector according to claim 8 in which the thermostatic disc member has an actuation temperature between approximately 70° C. and 175° C. at which temperature the disc will move from the first position in engagement to the second position out of engagement with the other of the cup-shaped housing member and the housing lid member.

13. A thermal protector according to claim 12 in which the thermostatic disc member has an actuation temperature of approximately 150° C.

14. A thermal protector according to claim 8 in which the thermostatic disc member has a reset temperature of no greater than −35° C. at which temperature the disc member will move from the second position out of engagement to the first position in engagement with the other of the cup-shaped housing member and the housing lid member.

15. A thermal protector according to claim 8 in which the thermostatic disc member comprises a plurality of metal layers bonded together with a first outer layer of relatively high coefficient of thermal expansion and a second outer layer having a relatively low coefficient of thermal expansion, the layers having similar moduli of elasticity and the second outer layer being a precipitation hardenable stainless steel.

16. A thermal protector according to claim 8 in which the welding platform extends beyond the electrically insulative element at least approximately 0.1054 cm.

17. A thermal protector having first and second ends along a length and having a selected width for use with an appliance having an electrical heater energizable through a terminal pin having a selected diameter and a longitudinal axis, the protector comprising an electrically conductive thermostatic member having first and second opposite ends, first and second electrically conductive housing members attached to one another through an electrically insulative element to electrically separate the housing members from one another, the first end of the thermostatic member mounted to one of the first and second housing members, the second end of the thermostatic member being movable between first and second positions in and out of engagement, respectively with the other of the first and second housing members, one of the first and second housing members having a welding platform extending along the length of the protector beyond the other of the first and second housing members and electrically insulative element, the platform extending essentially the entire width of the protector so that a terminal pin can be welded to the welding platform with the pin extending essentially the entire width of the platform oriented so that the longitudinal axis of the pin is generally parallel to the ends of the protector, the welding platform formed with a tab extending from the platform along a side thereof to serve as a stop for positioning a terminal pin at the time of welding.

18. A thermal protector according to claim 17 in which the thermostatic member is a snap acting disc member having an actuation temperature between approximately 70° C. and 175° C. at which temperature the disc will move from the first position in engagement to the second position out of engagement with the other of the first and second housing members.

19. A thermal protector according to claim 18 in which the thermostatic disc member has an actuation temperature of approximately 150° C.

20. A thermal protector according to claim 17 in which the thermostatic member is a snap acting disc member having a reset temperature of no greater than −35° C. at which temperature the disc member will move from the second position out of engagement to the first position in engagement with the other of the first and second housing members.

21. A thermal protector according to claim 17 in which the thermostatic member comprises a plurality of metal layers bonded together with a first outer layer of relatively high coefficient of thermal expansion and a second outer layer having a relatively low coefficient of thermal expansion, the layers having similar moduli of elasticity and the second outer layer being a precipitation hardenable stainless steel.

22. A thermal protector according to claim 17 in which the welding platform extends beyond the electrically insulative element at least approximately 0.1054 cm.

* * * * *